US012685428B2

(12) United States Patent
Wiles

(10) Patent No.: US 12,685,428 B2
(45) Date of Patent: Jul. 21, 2026

(54) DISHWASHER APPLIANCE DOOR POCKET HANDLE ASSEMBLY

(71) Applicant: Haier US Appliance Solutions, Inc., Wilmington, DE (US)

(72) Inventor: Zachary Wiles, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 77 days.

(21) Appl. No.: 18/735,572

(22) Filed: Jun. 6, 2024

(65) Prior Publication Data

US 2025/0375088 A1 Dec. 11, 2025

(51) Int. Cl.
*A47L 15/42* (2006.01)

(52) U.S. Cl.
CPC ..... *A47L 15/4265* (2013.01)

(58) Field of Classification Search
CPC ..... A47L 15/4265; A47L 15/4257; A47L 15/4293; E05B 1/0015; A47B 95/02; A47B 2096/208; A47B 2095/026; A47B 2095/027; A47B 2095/206
See application file for complete search history.

(56) References Cited

U.S. PATENT DOCUMENTS 10,227,793 B2 3/2019 Criner et al.
11,839,339 B2 12/2023 Kremmel et al.
2010/0236589 A1* 9/2010 House ..... A47L 15/4259 134/58 DL
2017/0096837 A1* 4/2017 Criner ..... E05B 1/0015
2020/0060509 A1* 2/2020 Ponkshe ..... A47L 15/4293
2023/0042049 A1* 2/2023 Kremmel ..... A47L 15/4257
2023/0145985 A1* 5/2023 Kremmel ..... A47L 15/4257 16/412
2023/0240505 A1* 8/2023 Kremmel ..... A47L 15/4257 292/336.3

(Continued)

FOREIGN PATENT DOCUMENTS

CN 108301686 A * 7/2018 ..... A47L 15/4257
CN 111631663 A * 9/2020 ..... A47L 15/4257

(Continued)

OTHER PUBLICATIONS

CN108301686 translation (Year: 2018).*

*Primary Examiner* — Hiwot E Tefera
(74) *Attorney, Agent, or Firm* — Dority & Manning, P.A.

(57) ABSTRACT

A dishwasher includes a door mounted to a tub of the dishwasher. The door includes an interior panel and a front panel spaced apart by a door cavity. The front panel defines a handle aperture including an aperture boundary surrounding the aperture. Additionally, the door includes a pocket handle assembly including a handle frame mounted to the front panel and defining a pocket recess positioned within the door cavity. The handle frame includes a plate protruding from a side of the handle frame for mounting the handle frame to the front panel. Furthermore, the pocket handle assembly includes a pocket handle mounted to the handle frame and accessible from the pocket recess. Moreover, the aperture boundary surrounds a pocket recess boundary, and a boundary gap is defined between the pocket recess boundary and the aperture boundary. Additionally, the plate inhibits movement between the handle frame and front panel.

17 Claims, 6 Drawing Sheets

(56) References Cited

U.S. PATENT DOCUMENTS

| | | | | |
|---|---|---|---|---|
| 2023/0277032 | A1* | 9/2023 | Kremmel | A47L 15/4257<br>134/201 |
| 2023/0371190 | A1* | 11/2023 | Berry | A47L 15/4293 |

FOREIGN PATENT DOCUMENTS

| | | | | |
|---|---|---|---|---|
| CN | 217129176 | U * | 8/2022 | |
| DE | 19907233 | A1 * | 8/2000 | A47L 15/4265 |
| DE | 102010028414 | A1 * | 11/2011 | F25D 23/028 |
| DE | 102014217238 | A1 | 3/2016 | |

* cited by examiner

DISHWASHER APPLIANCE DOOR POCKET HANDLE ASSEMBLY

FIELD OF THE INVENTION

The present disclosure relates generally to dishwasher appliances, and more particularly to pocket handle assemblies of dishwasher appliance doors.

BACKGROUND OF THE INVENTION

Dishwasher appliances generally include a tub that defines a wash chamber. Rack assemblies can be mounted within the wash chamber of the tub for receipt of articles for washing. Multiple spray assemblies can be positioned within the wash chamber for applying or directing wash fluid towards articles positioned within the rack assemblies in order to clean such articles. Further, dishwasher appliances typically include a door rotatably coupled with the cabinet for providing selective access to the wash chamber.

Some dishwasher appliance doors include a pocket handle assembly disposed within the door, and a user may insert his or her fingers into the handle to pull the door open. During assembly of the dishwasher appliance, the pocket handle assembly may not be positioned at a desired location for assembly and/or may shift relative to the door once in position and, thus, may not be assembled according to desired aesthetics and functionality.

Accordingly, a dishwasher appliance door including an improved pocket handle assembly would be desirable. More specifically, a pocket handle assembly for a dishwasher appliance door that provides improved positioning of the pocket handle assembly during and after assembly of the dishwasher appliance would be particularly beneficial.

BRIEF DESCRIPTION OF THE INVENTION

Aspects and advantages of the invention will be set forth in part in the following description, may be apparent from the description, or may be learned through practice of the invention.

In one aspect, a dishwasher appliance defining a vertical, a lateral, and a transverse direction is provided. The dishwasher appliance includes a tub defining a wash chamber for receipt of articles for washing and a door mounted to the tub for providing selective access to the tub. The door includes an interior panel and a front panel spaced apart from the interior panel by a door cavity. The front panel defines a handle aperture and includes an aperture boundary surrounding the handle aperture and including a receiving slot protruding therefrom into the door cavity. Moreover, the door includes a pocket handle assembly. The pocket handle assembly includes a handle frame mounted to the front panel within the door cavity and defining a pocket recess positioned within the door cavity. The handle frame includes a plate protruding from a side of the handle frame for mounting the handle frame to the front panel. Furthermore, the pocket handle assembly includes a pocket handle mounted to the handle frame and accessible from the pocket recess. Additionally, the aperture boundary of the front panel surrounds a pocket recess boundary of the pocket recess and a boundary gap is defined between the pocket recess boundary and the aperture boundary. Moreover, the receiving slot guides receipt of the plate therein for inhibiting relative movement between the handle frame and the front panel.

In another aspect, a dishwasher appliance defining a vertical, a lateral, and a transverse direction is provided. The dishwasher appliance includes a tub defining a wash chamber for receipt of articles for washing and a door mounted to the tub for providing selective access to the tub. The door includes an interior panel and a front panel spaced apart from the interior panel by a door cavity. The front panel defines a handle aperture and includes an aperture boundary surrounding the handle aperture. Moreover, the door includes a pocket handle assembly. The pocket handle assembly includes a handle frame mounted to the front panel within the door cavity and defining a pocket recess positioned within the door cavity. The handle frame includes a mounting feature protruding from a side of the handle frame for mounting the handle frame to the front panel. Furthermore, the pocket handle assembly includes a pocket handle mounted to the handle frame and accessible from the pocket recess. Additionally, the aperture boundary of the front panel surrounds a pocket recess boundary of the pocket recess and a boundary gap is defined between the pocket recess boundary and the aperture boundary. Moreover, the mounting feature inhibits relative movement between the handle frame and the front panel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
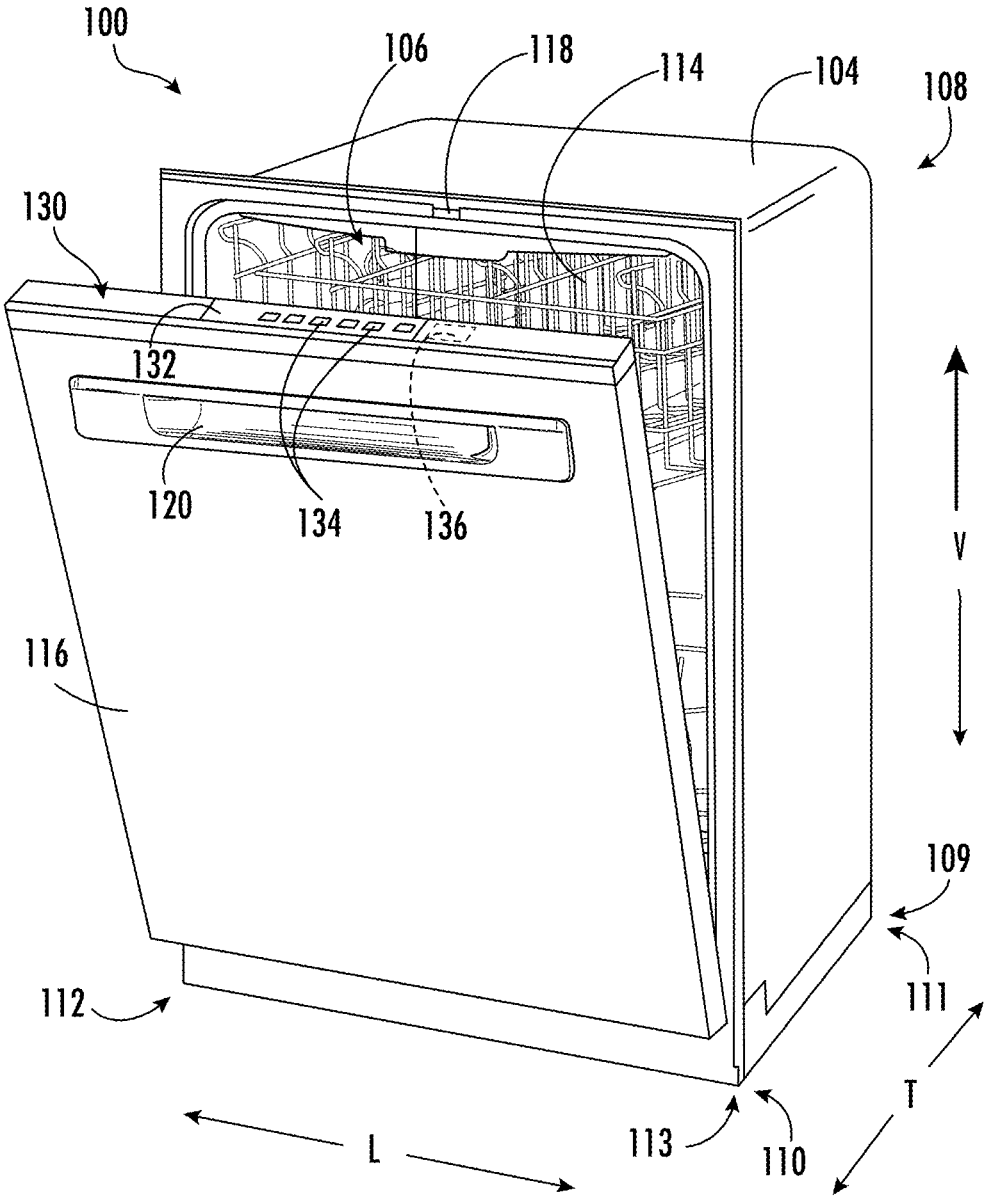
FIG. 1 provides a perspective view of a dishwasher appliance according to an example embodiment of the present disclosure with a door of the dishwasher depicted in a partially open position.

Reference now will be made in detail to embodiments of the invention, one or more examples of which are illustrated in the drawings. The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The term "at least one of" in the context of, e.g., "at least one of A, B, and C" refers to only A, only B, only C, or any combination of A, B, and C. In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

As used herein, the term "article" may refer to, but need not be limited to dishes, pots, pans, silverware, and other cooking utensils and items that can be cleaned in a dishwasher. The term "wash cycle" is intended to refer to one or more periods of time during which a dishwasher operates while containing the articles to be washed and uses a detergent and water to e.g., remove soil particles including food and other undesirable elements from the articles. The term "rinse cycle" is intended to refer to one or more periods of time during which the dishwasher operates to remove residual soil, detergents, and other undesirable elements that were retained by the articles after completion of the wash cycle. The term "drain cycle" is intended to refer to one or more periods of time during which the dishwasher operates to discharge soiled water from the dishwasher. The term "wash fluid" refers to a liquid used for washing and/or rinsing the articles and is typically made up of water that may include other additives such as detergent or other treatments.

FIG. 1 provides a dishwashing appliance or dishwasher appliance 100 according to an example embodiment of the present disclosure. It should be appreciated, however, that the present subject matter is not limited to any particular style, model, or configuration of dishwasher appliance 100. The embodiment depicted in FIG. 1 is for illustrative purposes only. As depicted, dishwasher appliance 100 defines a vertical direction V, a lateral direction L, and a transverse direction T. Each of the vertical direction V, lateral direction L, and transverse direction T are mutually perpendicular to one another and form an orthogonal direction system.

Dishwasher appliance 100 includes a tub 104 that defines a wash chamber 106 configured for receipt of articles for washing, such as pots, pans, dishes, silverware, etc. Tub 104 extends between a top 108 and a bottom 109 along the vertical direction V, between a front 110 and a back 111 along the transverse direction T, and a first side 112 (e.g., a left side) and a second side 113 (e.g., a right side) along the lateral direction L. Tub 104 includes or defines a front opening 114.

A door 116 is operatively coupled with tub 104. Door 116 provides selective access to wash chamber 106. For this embodiment, door 116 is hinged at its bottom with tub 104 for movement between a normally closed vertical position (not shown), wherein the wash chamber 106 is sealed shut for washing operation at front opening 114, and an open position for loading and unloading of articles from dishwasher appliance 100. Door 116 includes a handle 120, which may be part of a handle assembly, that a user may grip to move door 116 between the open and closed positions.

Dishwasher appliance 100 includes various features for washing articles within wash chamber 106. For instance, dishwasher appliance 100 can include rack assemblies mounted within the wash chamber 106 of tub 104 for receipt of articles for washing. Multiple spray assemblies can be positioned within the wash chamber 106 for applying or directing wash fluid towards or onto articles positioned within the rack assemblies in order to clean such articles. Such features are known in the art and thus will not be explained in detail herein.

As further shown in FIG. 1, dishwasher appliance 100 is equipped with a control panel 130. For this embodiment, control panel 130 is located at a top portion or top end of door 116. Generally, control panel 130 provides an interface that facilitates user interaction with dishwasher appliance 100. For instance, a user can select and execute various cycles (e.g., wash cycles and/or drying cycles) and settings using control panel 130. Particularly, control panel 130 includes a user interface 132. User interface 132 includes controls or input selectors 134 that allow a user to select various operational features and modes as well as to monitor progress of dishwasher appliance 100. The input selectors 134 can be one or more of a variety of electrical, mechanical or electro-mechanical input devices, including e.g., rotary dials, push buttons, and touch pads. In some embodiments, the user interface 132 may represent a general purpose I/O ("GPIO") device or functional block. The user interface 132 may include a display component, such as a digital or analog display device designed to provide operational feedback to a user. The user interface 132 may be in communication with a controller 136 via one or more signal lines or shared communication buses.

Controller 136 is operatively configured to regulate the operation of dishwasher appliance 100. Controller 136 can include one or more memory devices and one or more processors, such as general or special purpose microprocessors operable to execute programming instructions or micro-control code associated with a cleaning cycle, which can include a wash and drying cycle, for example. The one or more memory devices can represent random access memory such as DRAM or read only memory such as ROM or FLASH. In some embodiments, the one or more processors execute programming instructions stored in the one or more memory devices. The one or more memory devices may be separate components from the one or more processors or may be included onboard within the one or more processors. Alternatively, controller 136 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. In some embodiments, input/output ("I/O") signals may be routed between the control system and various operational components of dishwasher appliance 100 along wiring harnesses that may be routed through the bottom of door 116, for example.

Figure 2:
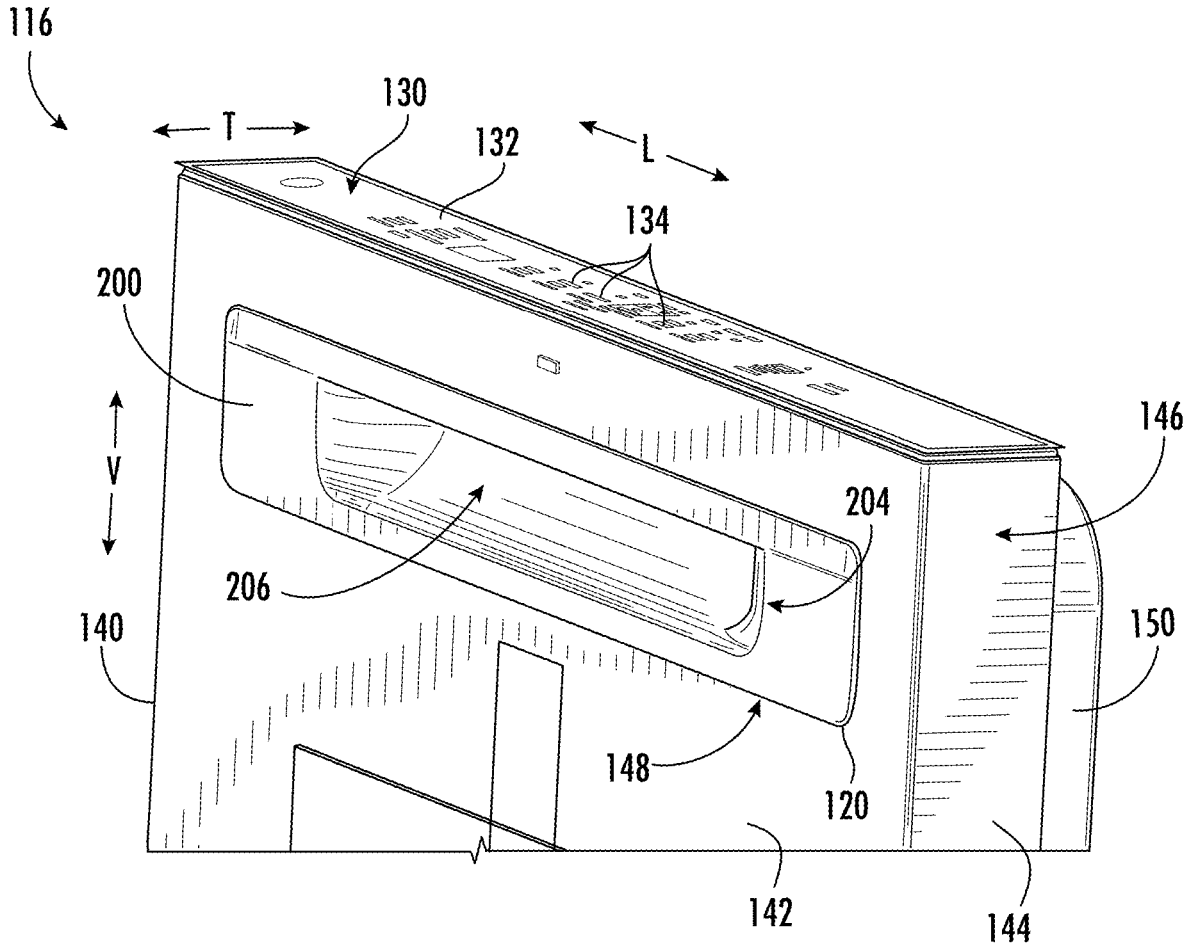
FIG. 2 is a partial perspective view of the door of the example dishwasher appliance of FIG. 1.

As shown in FIG. 2, a pocket handle 206 of a pocket handle assembly 200 may be used as handle 120. Pocket handle assembly 200 is described in greater detail below in the context of FIGS. 3 through 6. However, it will be understood that pocket handle assembly 200 may be used in or with other suitable appliances in alternative example embodiments. Pocket handle assembly 200 and other parts of door 116 may include features for positioning pocket handle assembly 200 and, once positioned, inhibiting movement of pocket handle assembly 200 during and after assembly of dishwasher appliance 100.

Door 116 may include a front panel 140 that defines a handle aperture 148. A size of handle aperture 148 may be selected such that pocket handle assembly 200 is receivable within door 116 at handle aperture 148. For example, a height of handle aperture 148, e.g., along the vertical direction V, may be no less than five centimeters (5 cm) and no more than twelve centimeters (12 cm). A width of handle aperture 148, e.g., along the transverse direction T, may be no less than forty-five centimeters (45 cm) and no more than one hundred centimeters (100 cm). Accordingly, handle aperture 148 may be wider along the transverse direction T and narrower along the vertical direction V.

Front panel 140 may include a front wall 142 and a pair of sidewalls 144. Sidewalls 144 may be oriented generally perpendicular to front wall 142, and sidewalls 144 may be positioned at opposite sides of front wall 142, e.g., along the lateral direction L. Handle aperture 148 may be defined in and through front wall 142. Front panel 140 may be formed from or with a piece of sheet metal bent to form front wall 142 and sidewalls 144. A rear or interior panel 150 may be mounted to front panel 140, e.g., with fasteners, to assist with forming door 116. Interior panel 150 may face towards wash chamber 106 and front panel 140 may face away from wash chamber 106 when door 116 is closed. Additionally, a door interior portion or cavity 152 (FIG. 3, 5, 6) be defined between front panel 140 and interior panel 150. Door cavity 152 may be filled with fiberglass or insulating foam, e.g., for thermal insulation, sound dampening, etc.

Control panel 130 may be mounted on door 116 such that control panel 130 is positioned at a top portion 146 of front panel 140, and handle aperture 148 may be disposed below control panel 130, e.g., along the vertical direction V, on front panel 140. For instance, handle aperture 148 may be no more than fifteen centimeters (15 cm) below control panel 130 in certain example embodiments. To allow mounting of control panel 130 at top portion 146 of front panel 140, a control panel bracket 170 may be disposed within door cavity 152, and control panel bracket 170 may be mounted within door cavity 152 such that control panel bracket 170 is fixed relative to front panel 140. For example, control panel bracket 170 may extend between sidewalls 144 along the lateral direction L within door 116, and control panel bracket 170 may also extend between front wall 142 and interior panel 150 along the transverse direction T. Control panel bracket 170 may be fastened to one or more of sidewalls 144 and interior panel 150 to mount control panel bracket 170 within door cavity 152. Control panel 130 may be positioned on and mounted to control panel bracket 170. For example, control panel 130 may be fastened, adhered, snap-fit, etc. to control panel bracket 170 at top portion 146 of front panel 140.

Figure 3:
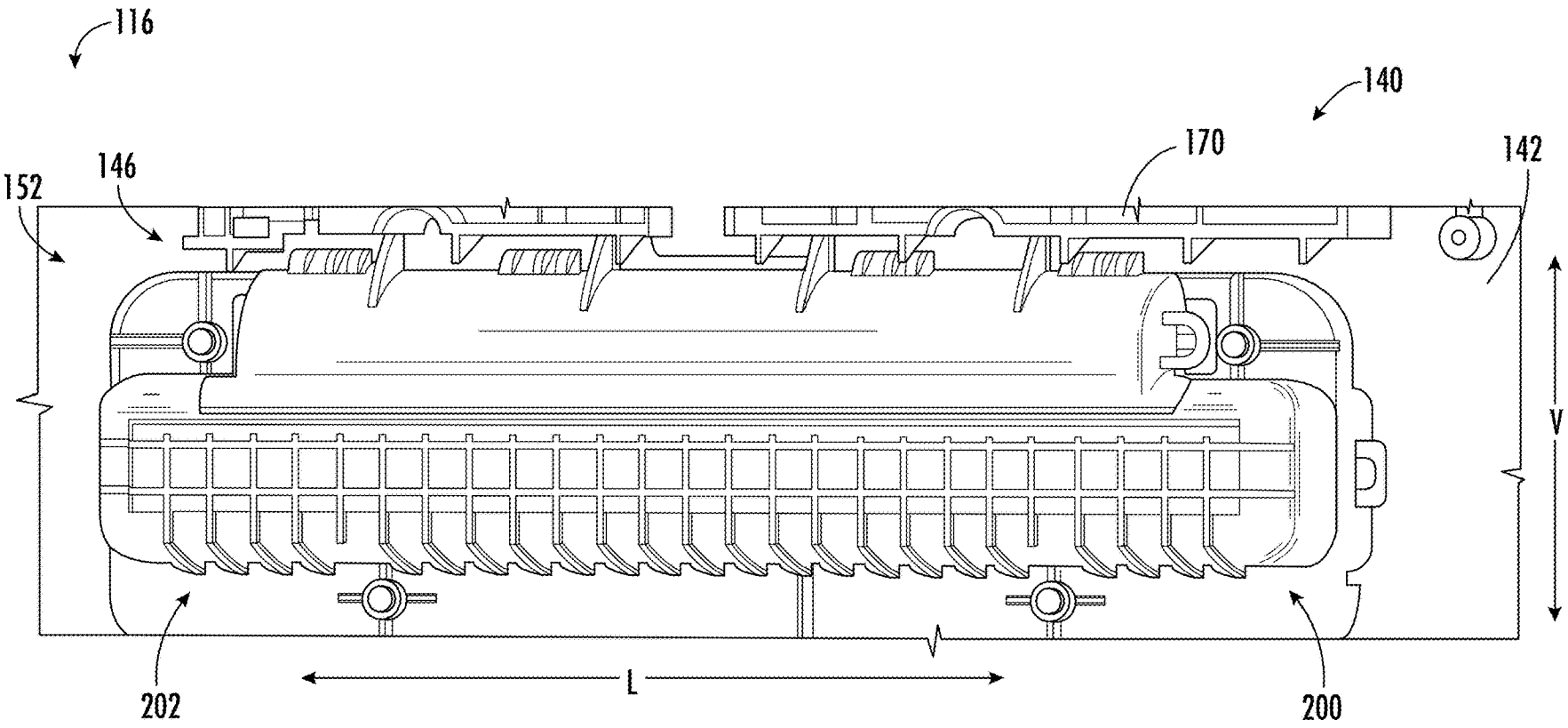
FIG. 3 is a perspective view of a pocket handle assembly mounted within the door of the example dishwasher appliance of FIG. 1 according to an example embodiment of the present subject matter.
Figure 4:
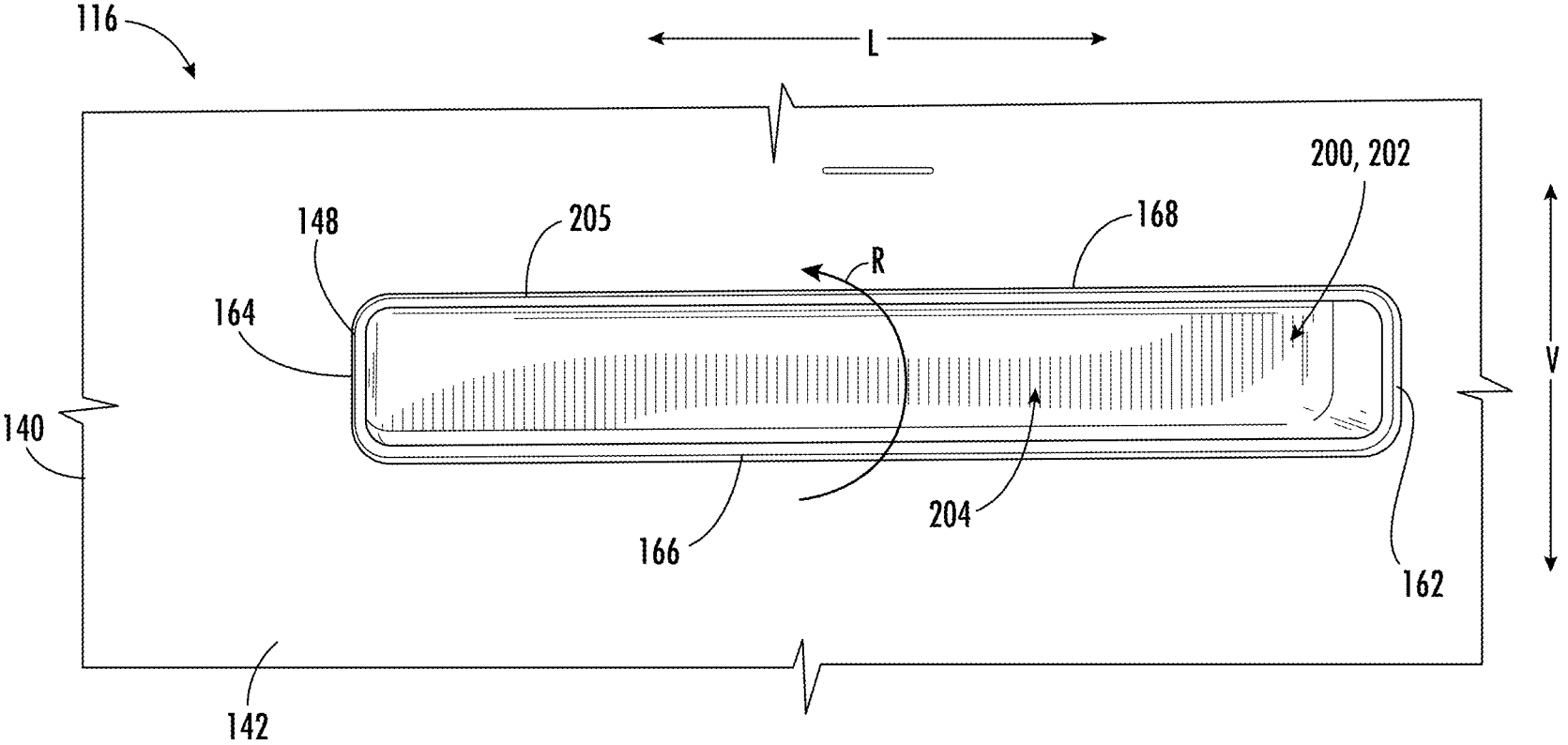
FIG. 4 is a perspective view of the example pocket handle assembly of FIG. 3 mounted within the door of the example dishwasher appliance of FIG. 1.
Figure 5:
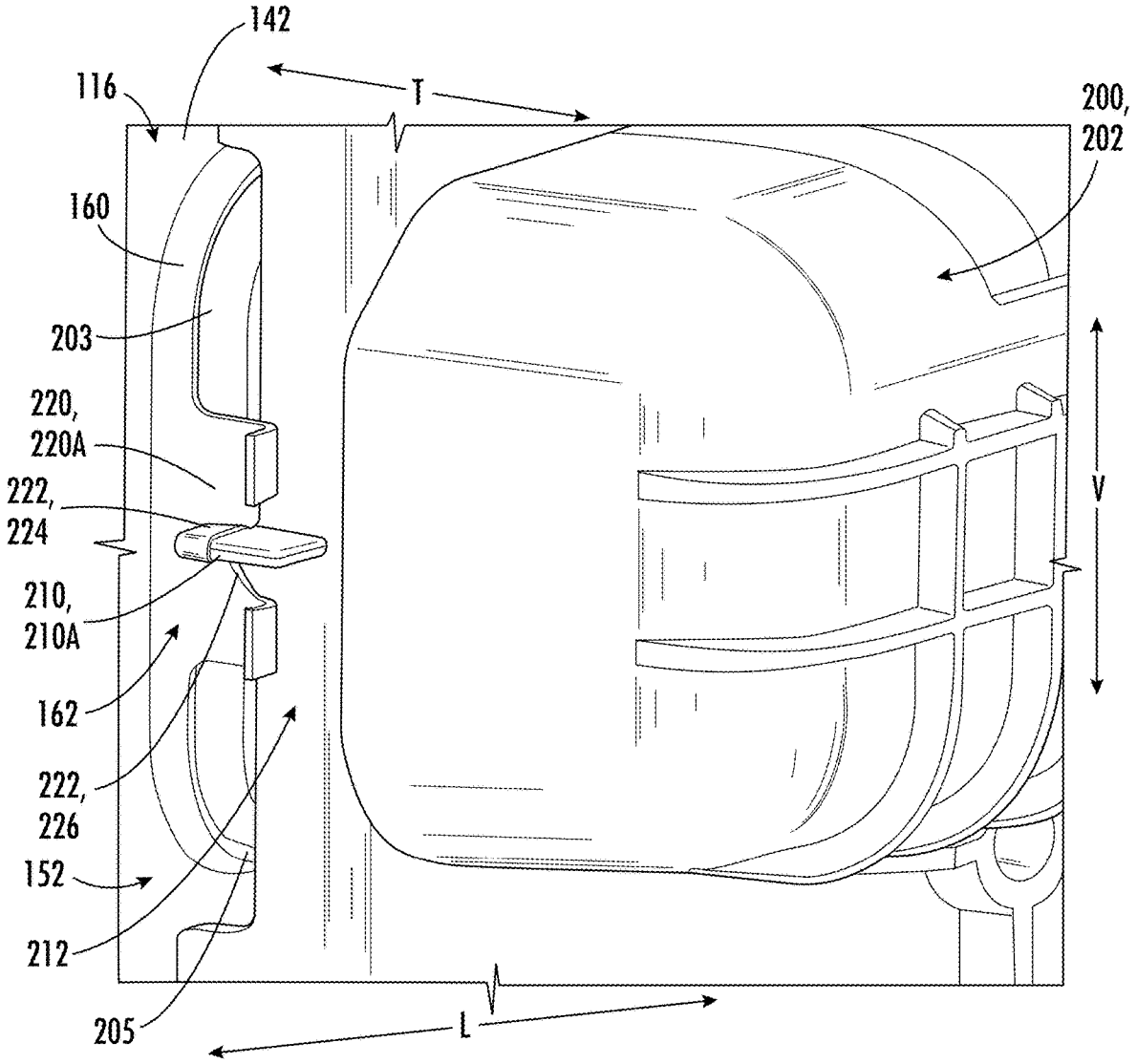
FIG. 5 is a close-up perspective view of the example pocket handle assembly of FIG. 3 mounted within the door of the example dishwasher appliance of FIG. 1.

As noted above, pocket handle assembly 200 is disposed within door 116 (i.e., within door cavity 152) at handle aperture 148 of front panel 140. Pocket handle assembly 200 may include a handle frame 202 defining a pocket recess 204 positioned within door cavity 152. For example, as best illustrated in FIGS. 3 through 5, pocket recess 204 may extend into door cavity 152 from handle aperture 148 in transverse direction T. As best illustrated in FIG. 3, pocket handle 206, which may be used as handle 120, may be mounted to handle frame 202 within door cavity 152 and accessible by a user of dishwasher appliance 100 from pocket recess 204 to open and close door 116.

Furthermore, as best illustrated in FIG. 5, handle aperture 148 may be surrounded by an aperture edge or boundary 160 extending from front wall 142 within door cavity 152. Pocket recess 204 may also be surrounded by a pocket recess boundary 203. Dimensions of pocket recess boundary 203 may be substantially similar to, but lesser than, dimensions of aperture boundary 160 such that pocket recess boundary 203 is insertable within and surrounded by aperture boundary 160. As best illustrated in FIG. 3, when pocket recess boundary is inserted within aperture boundary 160, a cover or boundary gap 205 is defined between aperture boundary 160 and pocket recess boundary 203 around a perimeter of pocket recess boundary 203.

Exemplary embodiments of the present description provide for features of pocket handle assemblies and doors of dishwasher appliances for positioning and mounting handle frames to doors of dishwasher appliances such that boundary gaps between handle frames and doors are visible from the exterior of dishwasher appliances. The boundary gaps create a desirable aesthetic for handles of dishwasher appliances, which may be recessed within doors of dishwasher appliances and appear integrally formed within doors of dishwasher appliances. Additionally, once positioned in place, features of pocket handle assemblies and doors of dishwasher inhibit movement of pocket handle assemblies relative to doors of dishwasher appliances. As such, features of handle frame 202 and door 116 may be used for positioning and mounting handle frame 202 to front wall 142 within door cavity 152. For example, handle frame 202 may include one or more mounting features, such as a rib(s) or plate(s) 210 (FIGS. 5, 6), for mounting handle frame 202 to front wall 142 within door cavity 152. For example, handle frame 202 may include a first plate 210A protruding/extending from a first lateral side 212 of handle frame 202 and a second plate 210B protruding/extending from a second lateral side 214 (FIG. 6) of handle frame 202 spaced apart from first lateral side 212 in lateral direction L. Additionally, or alternatively, in some embodiments, handle frame 202 may include a third plate 210C protruding/extending from a lower or bottom side 216 (FIG. 6) of handle frame 202 spaced apart from an upper or top side 218 (FIG. 6) of handle frame 202 in vertical direction V. Bottom side 216 may also be positioned between first lateral side 212 and second lateral side 214.

Additionally, aperture boundary 160 may include one or more guide features, such as a receiving boss(es) or slot(s) 220 (FIGS. 5, 6), protruding or extending therefrom into door cavity 152 for guiding plate(s) 210 for receipt therein to position handle frame 202 on door 116. For example, aperture boundary 160 may include a first receiving slot 220A protruding/extending from a first lateral side 162 of aperture boundary 160 and a second receiving slot 220B protruding/extending from a second lateral side 164 (FIG. 4) of aperture boundary 160 spaced apart from first lateral side 162 in lateral direction L. Additionally, or alternatively, in some embodiments, handle frame 202 may include a third receiving slot 220C protruding/extending from a lower or bottom side 166 (FIG. 4) of aperture boundary 160 spaced apart from an upper or top side 168 (FIG. 4) of aperture boundary 160 in vertical direction V. Bottom side 166 may also be positioned between first lateral side 162 and second lateral side 164.

Figure 6:
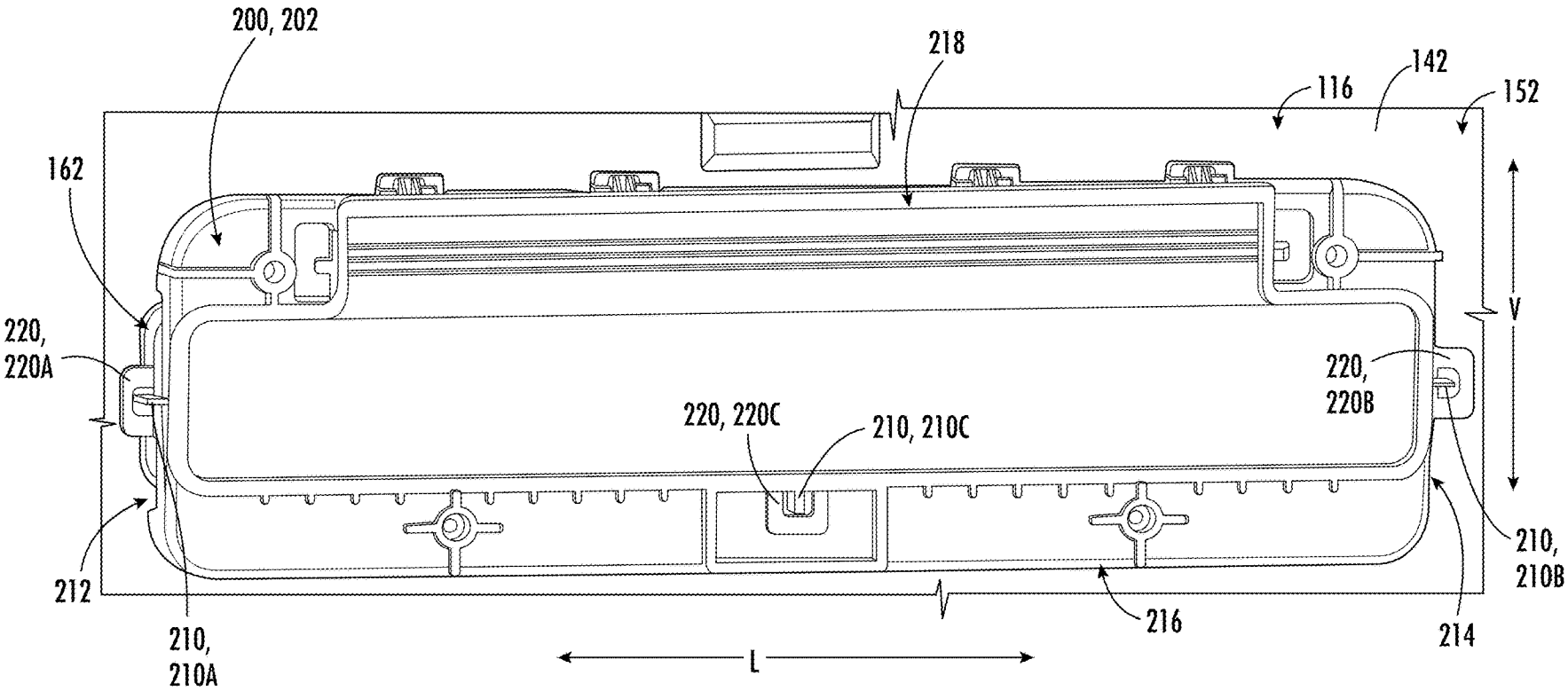
FIG. 6 is a perspective view of the example pocket handle assembly of FIG. 3 mounted within the door of the example dishwasher appliance of FIG. 1.

As illustrated in FIG. 6, each of first, second, and third plates 210A, 210B, 210C may correspond to first, second, and third receiving slots 220A, 220B, 220C respectively such that each plate 210A, 210B, 210C may be simultaneously guided for receipt in each corresponding receiving slot 220A, 220B, 220C. As such, each plate 210A, 210B, 210C may define a substantially uniform cross-section and each receiving slot 220A, 220B, 220C may define a bounded edge 222 that includes a wide portion 226 that is sloped or "funnel" shaped to guide each corresponding plate 210A, 210B, 210C toward a narrow portion 224 of bounded edge 222 of each receiving slot 220A, 220B, 220C. Narrow portion 224 has a narrower width than wide portion 226 of bounded edge 222. In this respect, each plate 210A, 210B, 210C may slide into each narrow portion 224 of corresponding receiving slot 220A, 220B, 220C and, once in the narrow portion 224, may be inhibited from moving. As such, handle frame 202 may be inhibited from moving relative to front panel 140 in vertical direction V and rotational direction R (FIG. 4). While rotational direction R is shown in a counterclockwise direction for purposes of illustration, it should be appreciated that the rotational direction may also be in the clockwise direction. As such, the dimensions of narrow portion 224 of bounded edge 222 of each receiving slot 220A, 220B, 220C may be substantially similar, but greater, than the dimensions of the corresponding plate 210A, 210B, 210C. For example, a tolerance between each plate 210A, 210B, 210C and narrow portion 224 of each corresponding receiving slot 220A, 220B, 220C, may be within about 0.003 inches to inhibit wiggling, jogging, or other movement of handle frame 202 relative to front panel 140.

Once each plate 210A, 210B, 210C is received within narrow portion 224 of bounded edge 222 of each corresponding receiving slot 220A, 220B, 220C motion of handle frame 202 relative to front panel 140 is inhibited. As such, bounded edge 222 of each of first receiving slot 220A and second receiving slot 220B is vertically bounded (e.g., bounded in vertical direction V) to inhibit relative motion of handle frame and front panel 140 in vertical direction V. Likewise, bounded edge 222 of third receiving slot 220C is laterally bounded (e.g., bounded in lateral direction L) to inhibit motion of handle frame 202 and front panel 140 in lateral direction L and a rotational direction R (FIG. 4).

As explained herein, aspects of the present subject matter are generally directed to a pocket handle assembly design of a dishwasher appliance that includes mounting features to be guided for receipt within guiding features of a door of the dishwasher appliance. The particular mounting features and guiding features facilitate placement/positioning of the pocket handle assembly on the door of the dishwasher appliance during assembly of the dishwasher appliance such that a gap is present between a door aperture of the door and the pocket handle assembly for desired aesthetics and functionality. Additionally, once in position, the particular mounting features and guiding features inhibit movement of the pocket handle assembly during and after assembly.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance defining a vertical, a lateral, and a transverse direction, the dishwasher appliance comprising:

a tub defining a wash chamber for receipt of articles for washing;

a door mounted to the tub for providing selective access to the tub, the door comprising:

an interior panel; and a front panel spaced apart from the interior panel by a door cavity, the front panel defining a handle aperture and including an aperture boundary surrounding the handle aperture and including a receiving slot protruding therefrom into the door cavity; and a pocket handle assembly, comprising:

a handle frame mounted to the front panel within the door cavity and defining a pocket recess positioned within the door cavity, the handle frame including a plate protruding from a side of the handle frame for mounting the handle frame to the front panel; and a pocket handle mounted to the handle frame and accessible from the pocket recess, wherein:

the aperture boundary of the front panel surrounds a pocket recess boundary of the pocket recess, and a boundary gap is defined between the pocket recess boundary and the aperture boundary;

the receiving slot defines a bounded edge that guides receipt of the plate therein for inhibiting relative movement between the handle frame and the front panel; and the bounded edge bounds the plate in at least one of the vertical direction or the lateral direction, whereby relative motion between the handle frame and the front panel in at least one of the vertical direction or the lateral direction is inhibited.

2. The dishwasher appliance of claim 1, wherein the aperture boundary comprises:

a first receiving slot protruding from a first lateral side of the aperture boundary; and a second receiving slot protruding from a second lateral side of the aperture boundary spaced apart from the first lateral side.

3. The dishwasher appliance of claim 2, wherein the handle frame comprises:

a first plate protruding from a first lateral side of the handle frame, the first plate configured to be received within the first receiving slot of the aperture boundary; and a second plate protruding from a second lateral side of the handle frame, the second lateral side laterally spaced apart from the first lateral side, the second plate configured to be received within the second receiving slot of the aperture boundary.

4. The dishwasher appliance of claim 3, wherein:

the first and second plates are vertically bounded within the first and second receiving slots respectively to inhibit relative motion of the handle frame and the front panel in a vertical direction.

5. The dishwasher appliance of claim 1, wherein:

the receiving slot protrudes from a bottom side of the aperture boundary, the bottom side positioned between a first lateral side and a second lateral side of the aperture boundary laterally spaced apart from each other.

6. The dishwasher appliance of claim 4, wherein:

the plate protrudes from a bottom side of the handle frame, the bottom side positioned between a first lateral side and a second lateral side of the handle frame laterally spaced apart from each other, and wherein the plate is configured to be received within the receiving slot of the aperture boundary.

7. The dishwasher appliance of claim 6, wherein:

the plate is laterally bounded within the receiving slot to inhibit relative motion of the handle frame and the front panel in a lateral direction.

8. A dishwasher appliance defining a vertical, a lateral, and a transverse direction, the dishwasher appliance comprising:

a tub defining a wash chamber for receipt of articles for washing;

a door mounted to the tub for providing selective access to the tub, the door comprising:

an interior panel; and a front panel spaced apart from the interior panel by a door cavity, the front panel defining a handle aperture and including an aperture boundary surrounding the handle aperture; and a pocket handle assembly, comprising:

a handle frame mounted to the front panel within the door cavity and defining a pocket recess positioned within the door cavity, the handle frame including a mounting feature for mounting the handle frame to the front panel; and a pocket handle mounted to the handle frame and accessible from the pocket recess, wherein:

the aperture boundary of the front panel surrounds a pocket recess boundary of the pocket recess, and a boundary gap is defined between the pocket recess boundary and the aperture boundary;

the aperture boundary includes a guide feature protruding therefrom into the door cavity, the guide feature defining a bounded edge that guides receipt of the mounting feature therein for inhibiting relative movement between the handle frame and the front panel; and the bounded edge bounds the mounting feature in at least one of the vertical direction or the lateral direction, whereby relative motion between the handle frame and the front panel in at least one of the vertical direction or the lateral direction is inhibited.

9. The dishwasher appliance of claim 8, wherein:

the mounting feature is a plate protruding from a side of the handle frame and defining a substantially uniform cross-section; and the guide feature is a receiving slot for guiding receipt of the plate therein.

10. The dishwasher appliance of claim 8, wherein the aperture boundary comprises:

a first guide feature protruding from a first lateral side of the aperture boundary; and a second guide feature protruding from a second lateral side of the aperture boundary spaced apart from the first lateral side.

11. The dishwasher appliance of claim 10, wherein the handle frame comprises:

a first mounting feature protruding from a first lateral side of the handle frame, the first mounting feature configured to be received within the first guide feature of the aperture boundary; and a second mounting feature protruding from a second lateral side of the handle frame, the second lateral side laterally spaced apart from the first lateral side, the second mounting feature con figured to be received within the second guide feature of the aperture boundary.

12. The dishwasher appliance of claim 11, wherein:

the first and second mounting features are vertically bounded within the first and second guide features respectively to inhibit relative motion of the handle frame and the front panel in a vertical direction.

13. The dishwasher appliance of claim 8, wherein:

the guide feature protrudes from a bottom side of the aperture boundary, the bottom side positioned between a first lateral side and a second lateral side of the aperture boundary laterally spaced apart from each other.

14. The dishwasher appliance of claim 13, wherein:

the mounting feature protrudes from a bottom side of the handle frame, the bottom side positioned between a first lateral side and a second lateral side of the handle frame laterally spaced apart from each other, and wherein the mounting feature is configured to be received within the guide feature of the aperture boundary.

15. The dishwasher appliance of claim 14, wherein:

the mounting feature is laterally bounded within the guide feature to inhibit relative motion of the handle frame and the front panel in a lateral direction.

16. A dishwasher appliance defining a vertical, a lateral, and a transverse direction, the dishwasher appliance comprising:

a tub defining a wash chamber for receipt of articles for washing;

a door mounted to the tub for providing selective access to the tub, the door comprising:

an interior panel; and a front panel spaced apart from the interior panel by a door cavity, the front panel defining a handle aperture and including an aperture boundary surrounding the handle aperture; and a pocket handle assembly, comprising:

a handle frame mounted to the front panel within the door cavity and defining a pocket recess positioned within the door cavity, the handle frame including a mounting feature for mounting the handle frame to the front panel; and a pocket handle mounted to the handle frame and accessible from the pocket recess, wherein:

the aperture boundary of the front panel surrounds a pocket recess boundary of the pocket recess, and a boundary gap is defined between the pocket recess boundary and the aperture boundary; and the aperture boundary includes a guide feature protruding therefrom into the door cavity, the guide feature comprising a wide portion and a narrow portion whereby the wide portion guides the mounting feature toward the narrow portion.

17. The dishwasher appliance of claim 16, wherein the wide portion of the guide feature is obliquely oriented relative to the narrow portion.

* * * * *